United States Patent [19]

Cavrich

[11] 4,019,257

[45] Apr. 26, 1977

[54] METHOD AND APPARATUS FOR DEVELOPING A GARMENT PATTERN

[76] Inventor: George Cavrich, 1285 Madison Ave., New York, N.Y. 10028

[22] Filed: Dec. 26, 1973

[21] Appl. No.: 427,453

Related U.S. Application Data

[63] Continuation-in-part of Ser. No. 245,131, April 18, 1972, abandoned.

[52] U.S. Cl. ..... 33/17 R

[51] Int. Cl.[2] ..... A41H 3/00

[58] Field of Search ..... 33/15, 17; 223/68

[56] References Cited

UNITED STATES PATENTS

| | | | |
|---|---|---|---|
| 355,583 | 1/1887 | Brooke | 33/15 |
| 385,637 | 7/1888 | Ledoux | 33/15 |
| 433,711 | 8/1890 | Berry | 33/15 |
| 447,554 | 3/1891 | Berry | 33/15 |
| 836,893 | 11/1906 | Quinn | 223/68 |
| 998,039 | 7/1911 | Rose | 33/15 |

*Primary Examiner*—Harry N. Haroian
*Attorney, Agent, or Firm*—Richard L. Cannaday

[57] ABSTRACT

A flexible garment pattern is formed from a self-supporting plastic shell initially placed on a mannequin. The shell is cut while draped on the mannequin to the desired style and shape and then separated into several pieces of three-dimensional shape. These pieces are used as pattern pieces to cut out fabric pieces for a garment.

The mannequin is provided with an adjustable fit plate in the bustline and kicker plates in the leg portion to impart a desired silhouette to the shaped shell.

6 Claims, 7 Drawing Figures

METHOD AND APPARATUS FOR DEVELOPING A GARMENT PATTERN

CROSS-REFERENCE TO RELATED APPLICATION

This application is a continuation-in-part of my copending application Ser. No. 245,131, filed in the U.S. Patent Office on Apr. 18, 1972, and now abandoned.

BACKGROUND OF THE INVENTION

This invention relates to a method and apparatus for developing a garment pattern. Still more particularly, this invention relates to a flexible garment pattern of three-dimensional shape.

Heretofore it has been known in the making of a garment, such as a dress, to form the garment from a predetermined pattern. In this regard the pattern has been used as a guide for the cutting of pieces of fabric of various sizes and shapes from a bolt of fabric. The cut pieces are thereafter sewn together in a suitable sequence to form the garment desired.

Generally the patterns which have been used have been developed from a mannequin or directly from a model. For example, in order to prepare a pattern for a particular garment such as a dress, it has been known to drape large pieces of material over a mannequin and to pin the pieces in various places so as to take on a particular style for the contour of the mannequin. Thereafter the material is cut at appropriate places where seams are desired and suitable places for tucks or darts are indicated. The various pieces of material are then sewn together into a fitting of said material and placed on the mannequin for further adjustments. Once the garment has been properly fitted, the various pieces of the garment are then separated and a pattern is made from these pieces.

It has also been known to have a pattern maker sketch the pattern pieces required for a garment without specific reference to a mannequin or model. The sketches are then used to obtain pieces of material which are thereafter pinned together on a model to determine the final fitting.

In both of these above instances considerable time and effort is required since the master pattern is not made directly from the mannequin in one step. Instead, it has been necessary to fit the master pattern onto the mannequin at least once more to obtain final adjustments.

Further, once the master pattern has been completed, it has been necessary to separate the pattern into pieces for cutting subsequent pieces of cloth for the garment to be joined. As the pieces are of cloth, such requires care to ensure that each pattern piece lies flat without wrinkling during a cutting operation of one or more dozen layers of cloth from the pattern piece.

Also, in some instances, in order for a garment maker to make patterns from different styles a number of mannequins have been used each of which corresponds to a particular style. This, however, requires additional expense due not only to the purchase price of the mannequin but also to the space required for storage.

SUMMARY OF THE INVENTION

Briefly, the invention relates to a method of making a flexible, pliable garment maker's pattern. The method employs a mannequin and self-supporting plastic shell which fits loosely over the mannequin and is supported at the bust, shoulder, shoulder blade and high point of the back of the mannequin. In order to make the pattern the plastic shell is initially placed over the mannequin, and is thereafter cut by a pattern maker by means of a suitable instrument such as a heated knife and shaped to the particular style garment desired while excess material is removed. After the cutting operation has been completed the shell is separated into a number of pieces that form a three-dimensional shape. These pieces form the developed flexible contour pattern pieces of the invention.

In order to duplicate the pattern, each pattern piece, where necessary, is slit at various edges so as to be flattened. The slits which are made in the pattern pieces open into V-shaped notches when the piece is flattened and correspond to the darts or tucks which are to be made for a garment. The pieces are then placed over a plurality of layers of fabric, e.g. a gross of layers, and flattened. A suitable cutting tool such as an electric saw is then guided around the flattened pattern to cut the stacked fabric. In this respect the fabric is cut with a sufficient margin to provide for seams. After the respective stacks of fabric are cut the fabric pieces are sewn into garments.

In order to provide one mannequin for any desired style, an adjustable fit plate is mounted in an upper portion about the bustline so as to be moved inwardly or outwardly of the mannequin to effect different contours dependent on the style of garment desired. This fit plate can be adjusted manually by suitable adjusting means in the mannequin. The adjusting means for adjusting the position of the fit plate is mounted within the upper half of the mannequin and is connected to the adjustable fit plate so as to pivot the plate relative to the remainder of the mannequin. The adjustment is controlled by a suitable mechanism situated atop of the uppermost portion of a mannequin. In addition, the mannequin has a pair of kicker plates adjustably mounted in respective leg portions of the mannequin corresponding to the legs of a garment wearer. These kicker plates are used to establish the stride of the wearer. These kicker plates can be adjusted independently of each other or can be adjusted in unison with each other. The kicker plates can be manually actuated since they would generally be accessible when the shell is in place.

It is noted that the fit plate in the bustline of the mannequin provides for a change in the silhouette of the garment to be designed. For example, by fully extending the fit plate outwardly of the mannequin a silhouette for a straight drape garment is provided. In the full retracted position a silhouette for a formbitting garment is provided. Of course any particular silhouette can be obtained with any other, intermediate position of the fit plate.

The plastic shell of the invention is of hollow construction and is provided with neck and arm holes. The shell is contoured to any suitable shape such as conical or a substantially cylindrical shape. In addition, the shell is contoured in the bustline, shoulder and back areas to more accurately fit to the mannequin. Also, the shell is provided with horizontal and vertical graduations which serve to align the various pieces cut from the shell. In use, the shell is positioned over the mannequin in a fully draped fashion and rests on the shoulder, bust and back portion of the mannequin. This is to ensure that the final garment will drape properly.

OBJECTS OF THE INVENTION

Accordingly, it is an object of the invention to provide a method of forming a garment maker's pattern directly from a mannequin.

It is another object of the invention to provide a plastic shell which can be used to form a multiplicity of garment sizes and styles.

It is another object of the invention to provide a technique for more easily, efficiently and quickly preparing a pattern for a garment.

It is another object of the invention to provide a garment maker's mannequin which is adjustable to different styles.

BRIEF DESCRIPTION OF THE DRAWINGS

These and other objects and advantages of the invention will become more apparent from the following detailed description and appended claims taken in conjunction with the accompanying drawings in which:

DESCRIPTION OF THE PREFERRED EMBODIMENTS

Figure 1:
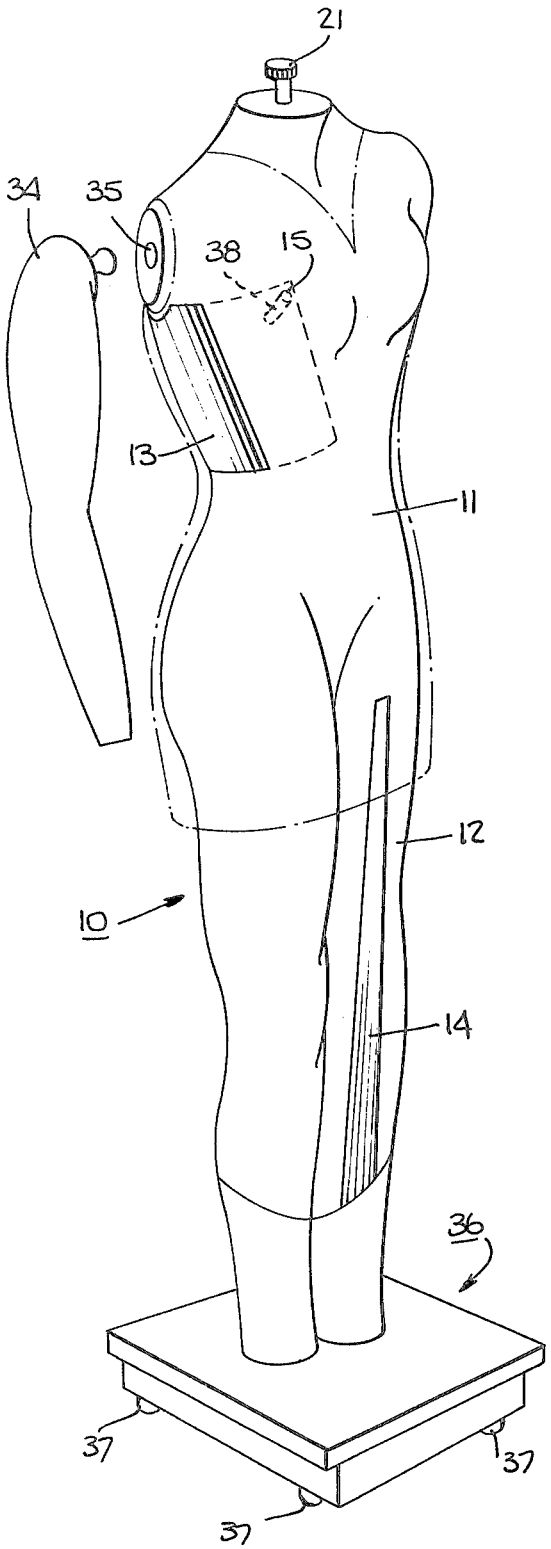
FIG. 1 illustrates a perspective view of a mannequin according to the invention.
Figure 2:
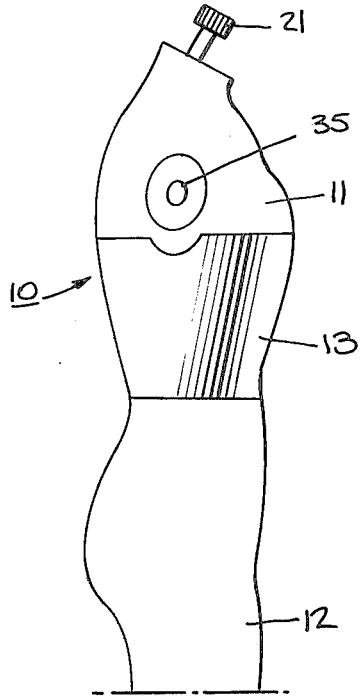
FIG. 2 illustrates a side view of the mannequin of FIG. 1 with the fit plate in retracted position.

Referring to FIG. 1, the mannequin 10 is formed of conventional contour shape and is provided with a body portion 11 and a leg portion 12 extending from the body portion 11. In addition, a fit plate 13 is mounted in one side of the upper portion of the body 11 in the region of the bustline. Also, a pair of kicker plates 14 are mounted in the leg portion 12 on opposite sides of the mannequin 10. These kicker plates 14 are disposed out of alignment with each other so as to correspond to the legs of a garment wearer. That is, one kicker plate 14 is located in the front in the position of the left leg of the mannequin 10 and the other kicker plate 14 is located in the back in the position of the right leg of the mannequin 10.

Figure 5:
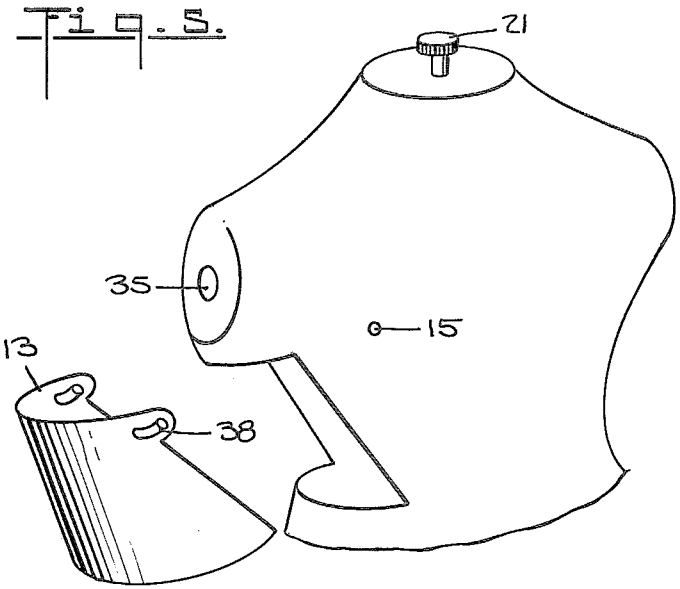
FIG. 5 illustrates a fragmentary view of the upper portion of the mannequin of FIG. 1.
Figure 7:
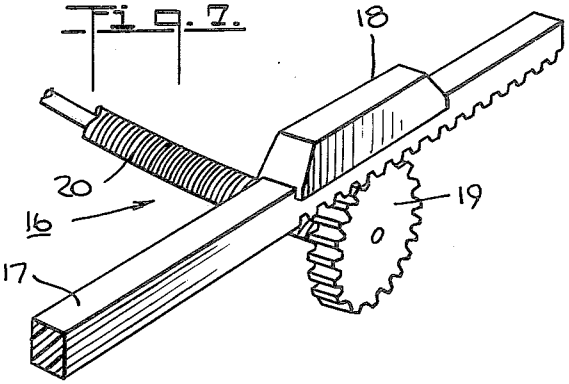
FIG. 7 illustrates an adjusting means for movement of the fit plate according to the invention.
Figure 6:
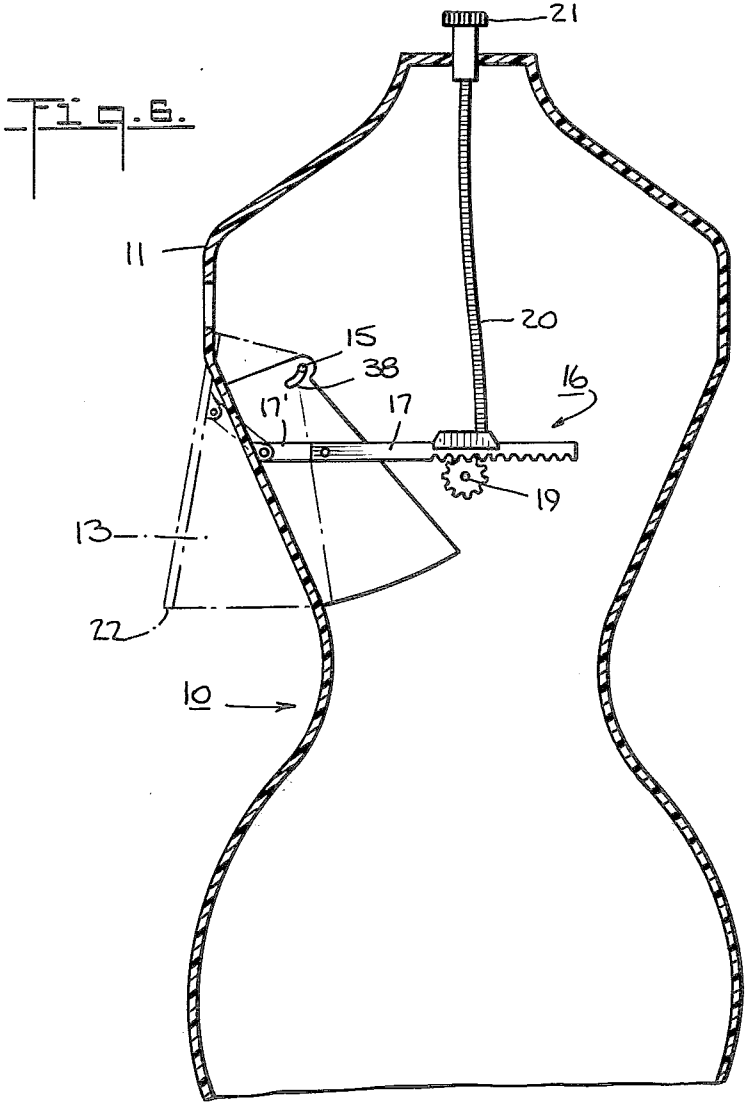
FIG. 6 illustrates a cross-sectional view of the upper portion of the mannequin of FIG. 1.

Referring to FIGS. 1, 5 and 6, the fit plate 13 is of generally U-shape and is mounted in the mannequin 10 so as to be moved between a retracted position within the body portion 11 in which the exposed surface of the fit plate 13 conforms with the remainder of the body portion 11 (FIG. 1) and a fully extended position outwardly of the remainder of the body portion 11 (FIG. 6) in which the surface of the fit plate 13 is discontinuous with the remainder of the body portion 11. To this end, the fit plate 13 is pivotally mounted at the front at a point 15 corresponding to the nipple of the right bust of the mannequin 10 and at the back at a point (not shown) horizontally aligned with point 15.

The fit place 13 is also connected intermediately thereof to an adjusting means 16 which serves to pivot the fit plate 13 about the pivot points. For example, the adjusting means 16 is formed by a ratchet bar 17 which is slidably mounted in a suitable bracket 18 secured within the body portion 11 of the mannequin 10 and a ratchet wheel 19 which is in meshing engagement with the ratchet bar 17. In addition, in order to rotate the ratchet wheel 19, a control mechanism is provided in the form of a flexible control cable 20 of suitable construction connected to the ratchet wheel 19 for rotating the wheel 19 about a fixed axis and a control knob 21 positioned at the uppermost point of the body portion 11 and connected to the cable 20. The control knob 21 is rotatable so as to cause rotation of the control cable 20 which in turn causes rotation of the ratchet wheel 19. The wheel 19 thus effects lateral movement of the ratchet bar 17. Alternatively, an electrical control mechanism can be provided in which a push button is mounted in place of the knob 21 and is used to actuate the adjusting means 16 for moving the fit plate 13 in or out, respectively. The ratchet bar 17 is further pivotally connected to the fit plate 13 at one end via an articulated extension 17′ so that upon movement of the ratchet bar 17 the fit plate 13 pivots about the pivot point 15 as well as about the ratchet bar 17.

Alternatively, the fit plate 13 can be mounted so that the lower edge of the outermost portion 22 is maintained in the same horizontal plane regardless of how far in or how far out the fit plate 13 is moved. To this end a shifting or sliding pivot arrangement is used to mount the fit plate 13 within the mannequin 10. In this case the fit plate 13 is provided with curved slots 38 (shown in dotted lines in FIG. 1) in front and back about the pivot point 15 while the ratchet bar 17 is fixed directly to the fit plate to move in a horizontal plane.

Figure 3:
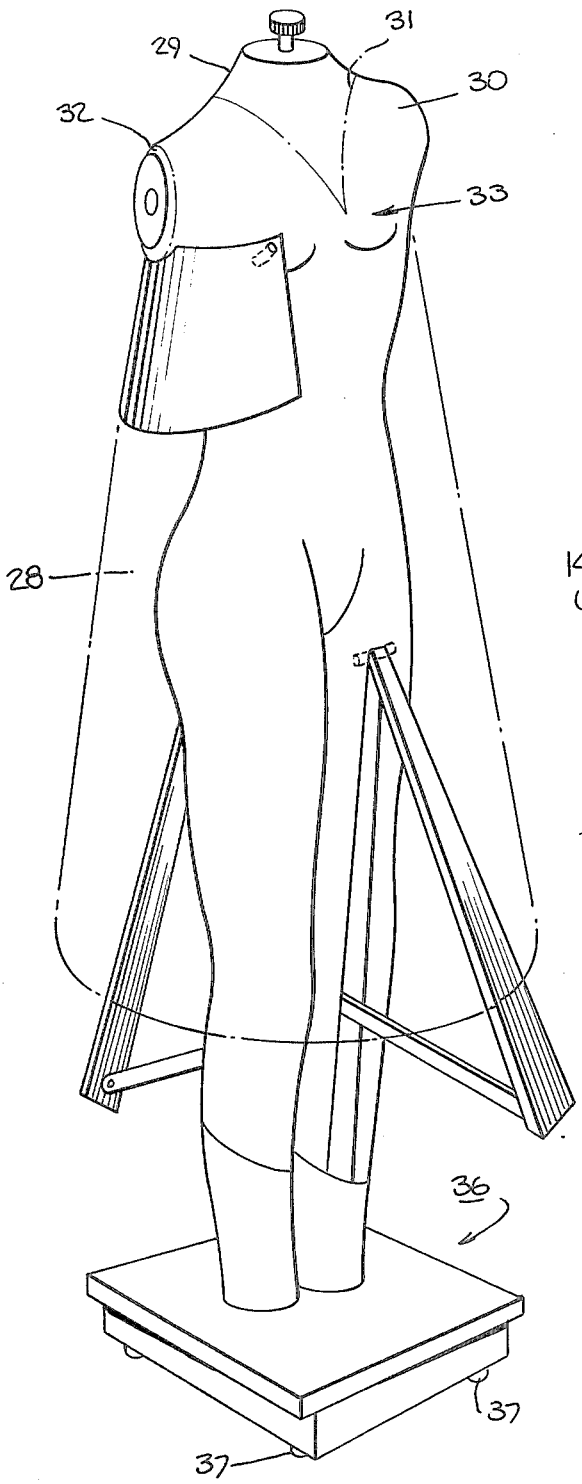
FIG. 3 illustrates a perspective view of a shell according to the invention draped over the mannequin of FIG. 1 with the fit plate in extended position.

The purpose of the inward and outward movement of the fit plate 13 is to provide the proper silhouette in the bustline region for the garment style to be made. For example, for a full length garment with a straight drape the fit plate 13 is swung to an outermost position so as to provide for a fullness in the bustline (FIG. 3). On the other hand, for a form-fitting garment the fit plate 13 is retracted into the innermost position (FIG. 1).

Figure 4:
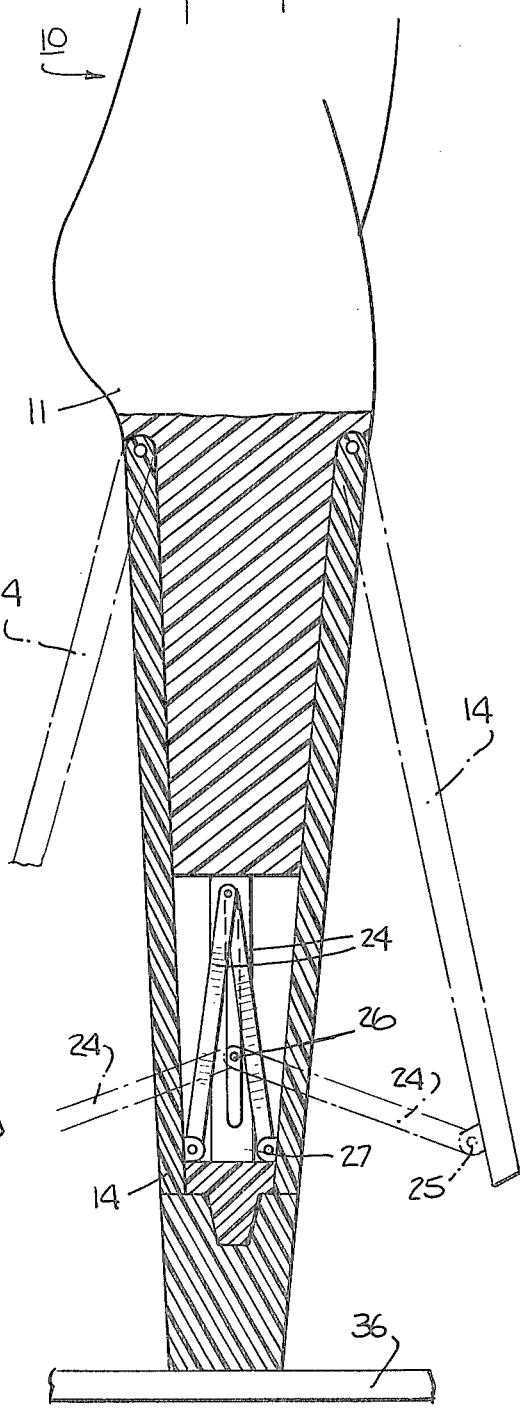
FIG. 4 illustrates a fragmentary cross-sectional view of the kicker plates according to the invention.

Referring to FIG. 4, each kicker plate 14 is pivotally mounted at one end to the leg portion 12 of the mannequin while the lower end is articulated to a pivoting mechanism 23 within the leg portion 12. For example, the lower end of each kicker plate 14 is pivotally mounted on a link 24 as by a suitable pin connection 25 while the opposite end of the link 24 carries a suitable guide pin 26 which is slidably mounted in a guideway 27 fixedly mounted within the leg portion 12. The guide pin 26 allows the link 24 to slide up and down within the guideway 27 as the link 24 causes the kicker plate 14 to pivot inwardly and outwardly of the leg portion 12. The two kicker plates 14 can be adjusted independently of each other or can be adjusted simultaneously by a suitable arrangement of the pivoting mechanism 23. For example, each link 24 can be mounted in separate guideways (not shown) or both links 24 can be mounted on a common pin or bar which is slidable in a single guideway between the links 24.

Referring to FIG. 3, the flexible shell 28, for example of plastic material, is of a pliable self-supporting nature and of generally hollow construction. The material from which the shell 28 is made is of a suitable stiffness so that the various pieces cut therefrom retain a three-dimensional shape while also of a suitable pliability so that the pieces can be flattened for cutting of the cloth.

The shell 28 is sized so as to be mounted on the mannequin 10 in a shroud-like fashion. To this end, the shell 28 has an enlarged opening at the lower end so as to fit over the mannequin 10 while the upper end of the shell 28 is contoured to conform to the shoulder portion 29 of the mannequin 10, i.e. with a rounded cross-sectional shape in the shoulder region 30. In addition, the shell 28 is provided with a neck opening 31 through which the control knob 21 of the adjusting means 16 for the fit plate 13 extends as well as a pair of arm holes 32 at the end of the shoulder region 30. The shell 28, in this instance, is of a conical shape. However, any other suitable shape can be used such as a generally cylindrical shape. Also, the shell 28 is contoured in the bustline 33 to generally conform to the bustline of the mannequin 10. The shell 28 can be fixed to the mannequin 10 by the use of push pins, or the like, located at three points, namely at the shoulder, the shoulder blade and the bust in order to facilitate the subsequent cutting and manipulation thereof.

In order to form a garment maker's pattern for a particular style of garment, the fit plate 13 of the mannequin is first adjusted to the condition needed to achieve that style. In addition, the kicker plates 14 are extended or retracted or at any rate adjusted to establish the spread corresponding to the desired stride for the wearer. Next the shell 28 is placed over the mannequin. Generally the shell would be sized or selected to aproximate the extended contour defined by the fit plate 13. In any event the pattern maker then proceeds to cut the shell 28, for example with an electric knife, on one side half of the mannequin 10, either the right side half or the left side half as most convenient, at various places at which a seam or seams would be made in a garment so as to shape the shell to the style desired for the garment. At substantially the same time as and after various cuts are being and have been made to remove excess material, adjacent but separated edges of the shell are pulled or drawn into essentially abutting relationship, including slightly overlapping relationship, and secured together in any suitable manner.

For instance, the shell can be provided initially with a full outer covering of a releasable self-adhesive sheet material which, after a cut has been made in the shell, can be peeled back from the cut edges and then, following removal of excess shell material and pulling together of the adjacent but separated shell edges, applied over the substantially abutting edges to hold them in that relationship. The shell can be provided also with a layer of adhesive and an overlying sheet of material which is releasably bonded to the adhesive. That sheet can be manipulated substantially as described above in connection with the self-adhesive sheet. Of course the adjacent but separated edges of the shell can be joined by simple strips of adhesive material or by staples or pins as those means may be on hand and convenient to use in a particular situation. In any event after the shell 28 has been cut and shaped into the desired contour for one selected side of the garment, markings are made on the shell to delineate patterns for the several pieces of the garment intended to be produced. The shell is then, optionally while still on the mannequin, cut along those markings or boundary or sewing lines and the several shell pieces so generated are removed from the mannequin as they are cut. These pieces will generally be of three-dimensional configuration and as such define the garment maker's pattern or components thereof. Further they are symmetrical from side to side of mannequin 10.

In order to make a garment from the pattern pieces the various pieces which requires such are slit at the edge so as to permit flattening of each. It is noted that the various slits which are made define V-shaped and other shaped grooves when the piece is flattened and as such define places where darts or tucks are needed in the garment. The flattened pattern pieces are then disposed over a plurality of layers of fabric and a suitable machine such as an electric saw is used to trace around the shape of the pattern piece to cut the layers of fabric. It is noted that since the plastic pieces are cut to the exact size that suitable margins are made on the fabric pieces during the cutting operation so that the fabric pieces can be subsequently sewn together. Duplicate fabric pieces can then be sewn together to form the two sides of a garment.

It is noted that the shell can be provided with a plurality of horizontal lines, graduations or grooves. These horizontal lines serve as a guide to align the various pieces of the shell during cutting and trimming operations.

It is further noted that the shell and mannequin of the invention can be used for making different sizes of a particular style garment. For example, the pattern pieces can be graded on a two-dimensional basis to other sizes of garments by offsets. Also, the mannequin and shell can be of the male form as well as the female form for the purpose of styling men's clothing. The shell, in such a case, would be utilized in a similar manner as above.

Referring to FIG. 1, a separate arm piece 34 is provided for fitting into a suitable socket 35 in the mannequin 10 while a separate plastic shell (not shown) is provided in order to develop a pattern for a sleeve required to complement the style of the garment to be made. To this end, the shell for the sleeve is of substantially cylindrical cross-section and of a slightly bent length corresponding to the natural shape of an arm in a position of rest alongside a body. Also, the fit plate 13 is contoured so as to avoid interference with the arm holes 32 of the shell 28 adjacent thereto. For example, the upper edge of the fit plate is recessed in the area below the arm socket 35 of the mannequin 10 so as to provide a slight clearance when the fit plate 13 is fully extended. The shell for the sleeve is cut and shaped in similar fashion to the above described shell and need not be further described. The pieces formed from such a sleeve shell are used as a rigid pattern to obtain fabric pieces for making the sleeves of a garment.

This invention thus provides a flexible pattern that can be used for repeated uses in the manufacture of a large number of garments. Furthermore, since the pattern is a three-dimensional pattern such will provide pieces of fabric which will more accurately fit together into a garment.

The invention further provides a technique of accurately forming a master pattern in a single-phase operation directly from a mannequin. The technique does not require the preparation of a garment from the pattern to determine whether or not the garment requires any further alterations.

It is noted that the mannequin can be mounted on a suitable support frame 36 which is mounted on casters 37 so as to be moved from place to place. For example, the support frame 36 can have a circular shape.

It is further noted that where required the mannequin can be formed with adjustable fit plates on opposite sides as well as in any other area for adjustment inwardly and outwardly of the mannequin. For example, such an additional fit plate can be mounted in the lower leg region of the mannequin for bell-bottom pants and can be actuated in a similar manner to the bustline fit plate.

The lateral excursion of the fit plate 13 from the mannequin 10 at the lowermost portion 22, assuming a conventional size ten female mannequin having a bustline of thirty-five inches and a waist of twenty-four inches, is a maximum of, for example, five inches. Further, for a male mannequin, for example a size forty-two, the lateral excursion would be a maximum of four inches.

It is noted that the fit plate can also be made of a flexible material which is suitably guided in passing out of the mannequin so as to be bowed into a shape which increases the cross-section of the mannequin below the bustline. In such a case the portion of the fit plate extending along the back of the mannequin would be substantially straight while the portions at the front and sides of the mannequin would be progressively bowed to a greater extent as the fit plate is extended.

Further, traced patters can also be prepared from each flattened piece of the shell as that each traced pattern is useful as a template of a garment pattern for preparing individual pieces of cloth to be pieced together into a complete garment. Also, each template can be provided with a margin to provide for seaming of subsequently cut pieces of cloth.

CONCLUSION

Protection by Letters Patent of the present invention in all its aspects as the same are set forth in the appended claims is sought to the broadest extent that the prior art allows.

I claim as my invention:

1. A method of making a garment pattern comprising the steps of 1. adjusting a mannequin characterized by at least one moveable contour element to establish a contour of said mannequin corresponding to a predetermined style of garment for which a pattern is desired;
2. positioning a self-supporting shell over the mannequin as adjusted so that said shell is supported on the mannequin at the shoulders, bust and back thereof;
3. cutting the shell on at least one side to remove excess material therefrom while at substantially the same time and thereafter shaping the remainder of the shell to the contour of the mannequin and securing the shell in that contour thereby imparting to it a style corresponding to said predetermined style;
4. making markings on the shell while it is still on the mannequin to delineate patterns for the several pieces of the garment intended to be produced, and
5. cutting the shell along said markings to generate a plurality of pattern pieces of three-dimensional configuration.

2. A method of making a garment pattern according to claim 1 which further comprises the step of flattening each of said pattern pieces over a plurality of layers of garment fabric to provide for a plurality of pieces of fabric for a plurality of garments.

3. A method of making a garment pattern according to claim 1 which further comprises the step of slitting each three-dimensionally configured pattern piece at its edges to permit each such piece to be flattened whereby the slits indicate the positions of spread-shape areas for taking darts or tucks in fabric pieces prepared from the pattern pieces.

4. A method of making a garment pattern according to claim 3 which further comprises the step of preparing a traced pattern from each of said pattern pieces as flattened whereby each traced pattern is useful as a template of a garment element for cutting individual pieces of fabric to be joined into a complete garment.

5. A method of making a garment pattern according to claim 4 which further comprises the step of forming a margin on each of said templates to provide for seaming of pieces of fabric cut subsequently therefrom.

6. A method of making a plurality of garment pattern pieces and fabric pieces therefrom comprising the steps of 1. adjusting a mannequin characterized by at least one moveable contour element to establish a contour of said mannequin corresponding to a predetermined style of garment for which a pattern is desired;
2. positioning a self-supporting shell over the mannequin as adjusted so that said shell is supported on the mannequin at the shoulders, bust and back thereof;
3. cutting the shell on at least one side to remove excess material therefrom while at substantially the same time and thereafter shaping the remainder of the shell to the contour of the mannequin and securing the shell in that contour thereby imparting to it a style corresponding to said predetermined style;
4. making markings on the shell while it is still on the mannequin to delineate patterns for the several pieces of the garment intended to be produced;
5. cutting the shell along said markings to generate a plurality of pattern pieces of three-dimensional configuration;
6. forming each of said three-dimensionally configured pattern pieces into a flat piece;
7. positioning each flattened pattern piece on a plurality of layers of garment fabric, and
8. cutting said layers in conformance with the shapes of said pattern pieces as flattened to generate a plurality of garment fabric pieces corresponding to each of said pattern pieces.

* * * * *